US007055430B2

(12) United States Patent
Hesterman

(10) Patent No.: US 7,055,430 B2
(45) Date of Patent: Jun. 6, 2006

(54) MACHINE FOR SHEET-FED ROTARY PRINTING OR SHEET COATING

(76) Inventor: Ebe Hesterman, Curiestraat 7, 1171 BG Badhoevedorp (NL)

( * ) Notice: Subject to any disclaimer, the term of this patent is extended or adjusted under 35 U.S.C. 154(b) by 67 days.

(21) Appl. No.: 10/799,644

(22) Filed: Mar. 15, 2004

(65) Prior Publication Data

US 2004/0245712 A1 Dec. 9, 2004

(30) Foreign Application Priority Data

Mar. 17, 2003 (DE) ..... 103 12 153

(51) Int. Cl.
*B41F 1/30* (2006.01)
*B41F 13/24* (2006.01)

(52) U.S. Cl. ..... 101/408; 101/419; 101/232

(58) Field of Classification Search ..... 101/232, 101/246, 407, 408, 409, 419, 420, 423, 424.1
See application file for complete search history.

(56) References Cited

U.S. PATENT DOCUMENTS

| | | | | |
|---|---|---|---|---|
| 5,103,733 | A * | 4/1992 | Drapatsky et al. | 101/485 |
| 5,135,724 | A * | 8/1992 | Dinter et al. | 422/186.05 |
| 6,311,616 | B1 * | 11/2001 | Kamoda | 101/216 |
| 6,349,641 | B1 * | 2/2002 | Bayer et al. | 101/142 |
| 6,490,974 | B1 * | 12/2002 | Wadlinger et al. | 101/232 |

FOREIGN PATENT DOCUMENTS

| | | |
|---|---|---|
| DE | 100 04 997 | 9/2000 |
| DE | 100 39 073 | 2/2002 |
| DE | 100 41 934 | 3/2002 |
| DE | 101 06 385 | 4/2002 |
| JP | 591 31 460 | 7/1984 |

* cited by examiner

*Primary Examiner*—Ren Yan
(74) *Attorney, Agent, or Firm*—Paul Vincent

(57) ABSTRACT

A machine for sheet-fed rotary printing or sheet coating has a sheet gripper system, an upstream feed system, and an upstream feeder. A surface refinement station for the sheet is disposed downstream of the feeder and upstream of a transfer of the sheet to the sheet gripper system.

20 Claims, 5 Drawing Sheets

MACHINE FOR SHEET-FED ROTARY PRINTING OR SHEET COATING

This application claims Paris Convention priority of DE 103 12 153.6 filed Mar. 17, 2003 the complete disclosure of which is hereby incorporated by reference.

BACKGROUND OF THE INVENTION

The invention concerns a machine for sheet-fed rotary printing or sheet coating comprising the features of the independent claim.

Corona treatment involves electric flaming at a high voltage. The ionised air between the electrodes corrodes the surface of the plastic material in response to ozone and oxygen, i.e. oxidation. Polar groups are generated on the plastic surface which are easy to wet.

In practice, corona treatment has advanced to one of the most frequently used methods for surface refinement. It increases the surface tension of polymeric films and foils, aluminium foils, laminated paper and cardboard as well as sandwiched materials before they are printed, glued or coated. This surface treatment improves adhesion between the layers to be connected or adhesion of the coating substance or color. The final effects of the treatment depend on various parameters such as the power of the electrodes, duration of discharge, type of material treated, temperature and moisture, possible impurities, surface morphology and mainly the minimum gap width.

The mechanical construction must be robust. The electrode segments must maintain their settings despite vibration of the system and other unfavorable conditions.

JP 591 31 460 A discloses a device for treatment of sheet-like substrates. However, full-surface corona treatment does not require precise, registered transport and therefore no gripper technology is used for the sheet transport. The flat sheets are transported on belts using vacuum and without grippers. Setting of the gap width is therefore straightforward, resulting in stable handling.

DE 100 41934 discloses a corona device which is used after the last printing mechanism. This reference does not address the problem of minimum gap width, since the gap width is less critical for this varnish coating of printed paper. This corona device is used at a completely different location than in the present invention.

Corona treatment of sheet-like materials in the printing industry is an established technology (DE 199 10 740, DE 198 43 955, DE 101 06 385). The gap width of a few millimeters includes the thickness of the substrate sheet plus a gas gap above the substrate surface to be treated.

The sheet-like substrates require gripper elements for exactly registered transport whose gripper backs must therefore be disposed several millimeters above the substrate surface. The gap width above the substrate surface to be treated is therefore too large for optimum corona treatment.

DE 100 39 073 represents the principal prior art and main reference point, wherein, despite the use of grippers, an optimum gap width is nevertheless obtained by providing a lifting device or gripper recesses.

The substantial disadvantage of this arrangement is that a lifting motion at high speeds is a problem per se and also includes the risk of vibrations. A drum with gripper recess is format-related and therefore relatively large and expensive due to additional insulation.

Moreover, drums of such large size cannot be integrated in the first printing or coating mechanism due to access problems.

A sheet acceleration path is required between the stacked feeder and the first printing mechanism. The printing cylinder moves constantly at the printing speed. The supply system must precisely guide the sheet, bring it up to the printing speed, and transfer it to the grippers of the printing cylinder.

This object has been achieved in many machines using pivoting grippers, disposed above or below the sheet.

Alternatively, a so-called ranger drum, stop drum system or suction drum system can be used. None of the above-mentioned feed systems can accommodate surface refinement systems, so-called e.g. corona treatment systems, for reasons of space.

These sheet substrates can be pre-treated in a separate working step, which involves additional cost and time. Moreover, the corona charge loses its effectivity with time.

In accordance with a press report by the company König and Bauer in "Deutscher Drucker" dated 13 Nov. 2003, the printability of e.g. plastic materials can be improved by installing an additional upstream corona tower. This arrangement requires great expense and space (grosso modo 75% of the price of a printing mechanism).

Alternatively, the printing material can be coated with a primer as primary coating, which necessitates an additional printing mechanism and associated dryers in the printing machine (see DE 100 04 997 A1). Printing machines having such equipment are therefore expensive.

It is the underlying purpose of the invention to develop a novel sheet supply system, with appropriate geometry, to exactly guide and bring the sheet up to the subsequent printing speed and to transfer it to the grippers of the printing cylinder, wherein the front side and/or the back side of the sheet is/are subjected to surface treatment, e.g. corona treatment, and without additional upstream drums, transfer cylinders or printing mechanisms.

SUMMARY OF THE INVENTION

This object is achieved in accordance with the present invention by a sheet supply system having the characterizing features of the independent claim. Reference is made to the dependent claims with respect to further important embodiment features.

Further details and advantageous effects of the invention can be extracted from the following description and the drawings which show embodiments of the inventive sheet printing machine.

DESCRIPTION OF THE PREFERRED EMBODIMENT

Figure 1:
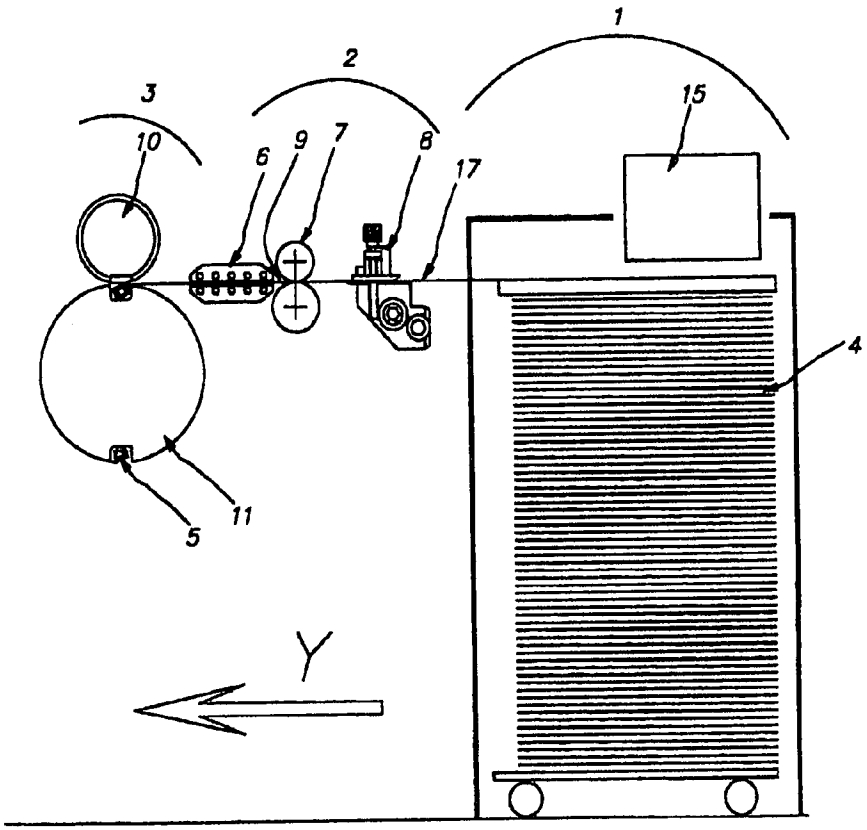
FIG. 1 shows a side view of a sheet-fed rotary printing or coating machine with upstream feeder and system.

The side view of the system shown in FIG. 1, shows a conventional deep-pile feeder 1 for a machine 3 with gripper technology 5 for processing sheets. The system 2 must precisely guide and bring the sheet to the continuous printing speed and transfer it to the grippers 5 of the counterpressure cylinder 11.

Exact alignment is effected e.g. at a stopping moment approximately at 9, wherein the sheet is aligned in the peripheral direction e.g. via a conveying mark (not shown) and laterally e.g. via a side mark 8 before being accelerated e.g. by the drawing rollers 7.

A surface treatment system 6 is integrated in this system 2 arrangement such that the sheet can be treated from the top and/or from below, e.g. through corona treatment.

Figure 2:
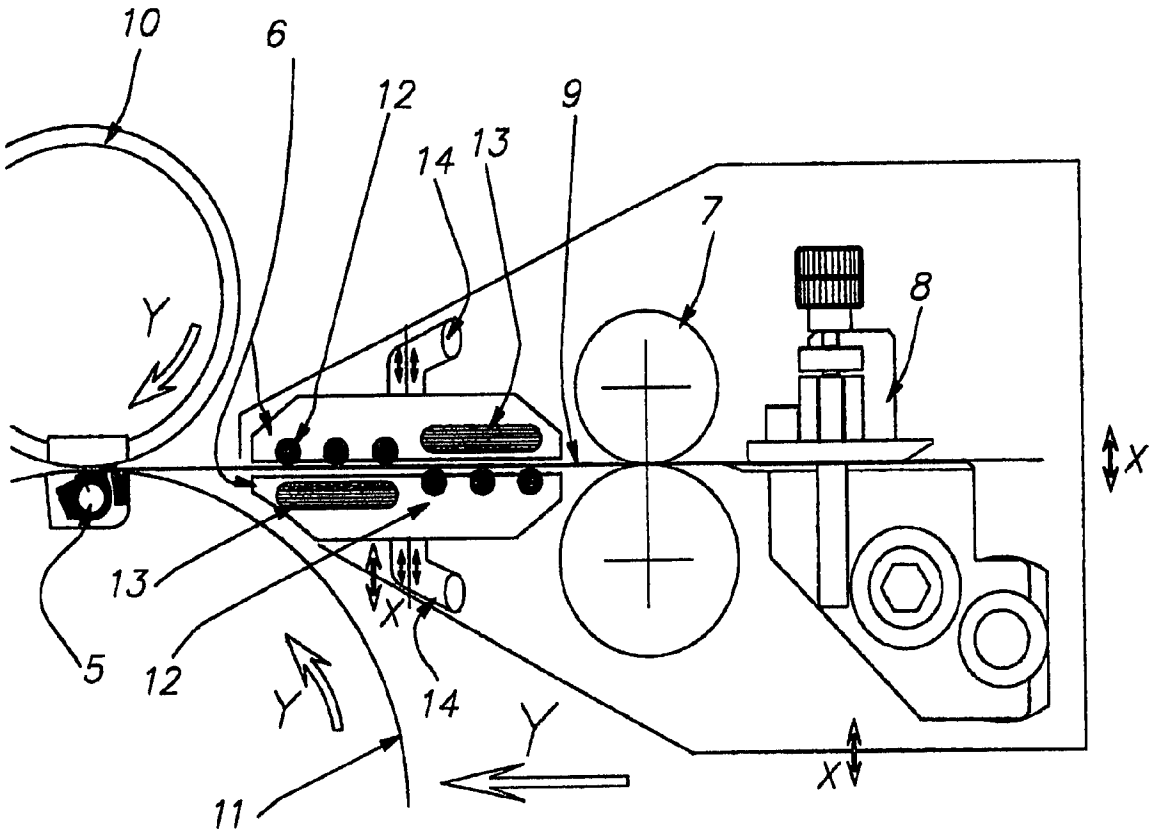
FIG. 2 shows a side view of the system.

FIG. 2 shows a side view in the running direction Y of the side mark 8, the drawing rollers 7, the stopping moment 9, the two chambers of the surface treatment system 6, the access for controlled suctioned and/or blown air 14, electrodes 12 and opposing terminals 13. This system unit is disposed in a frame.

Figure 3:
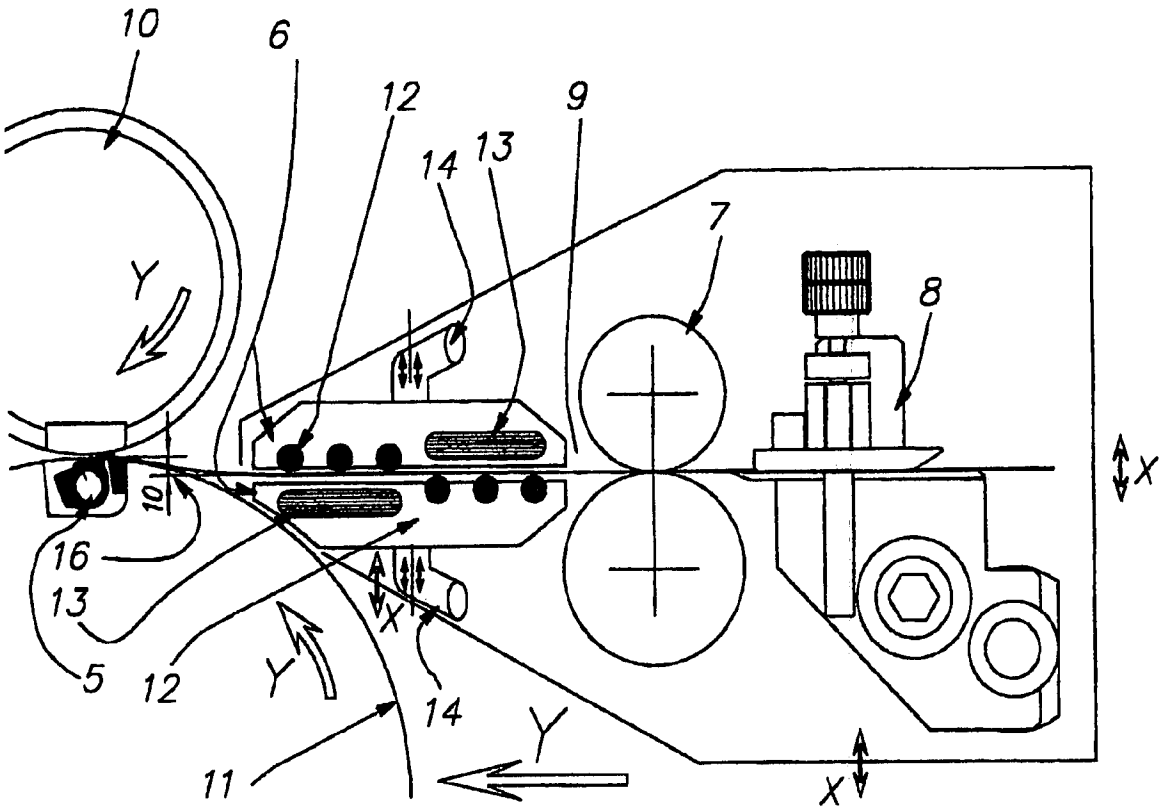
FIG. 3 shows a side view of the system lowered by 10 mm.

FIG. 3 shows a side view of the feed unit of FIG. 2 which is downwardly displaced by e.g. 10 mm by the adjustment device X which curves 16 the flexible substrate when the sheet enters to have an advantageous effect on the accuracy of the feed passer.

The feed system including its surface refinement system 6, e.g. a corona treatment system, drawing rollers and sheet alignment mechanisms can be adjusted in height by an amount X to permit deflection of the substrate at that moment when the sheet is guided to the stop within the grippers 5, in dependence on the paper thickness. Thicker substrates such as cardboard are introduced almost horizontally. For more flexible and curved substrates, the feed system 2 is downwardly adjusted.

The gripper strip 5 can be adjusted to produce a peripheral and diagonal register.

To ensure that the sheet flatly abuts on the cylinder shell of the counterpressure cylinder 11, one of the chambers can be loaded with suctioned air to facilitate slight slowing of the substrate.

Figure 4:
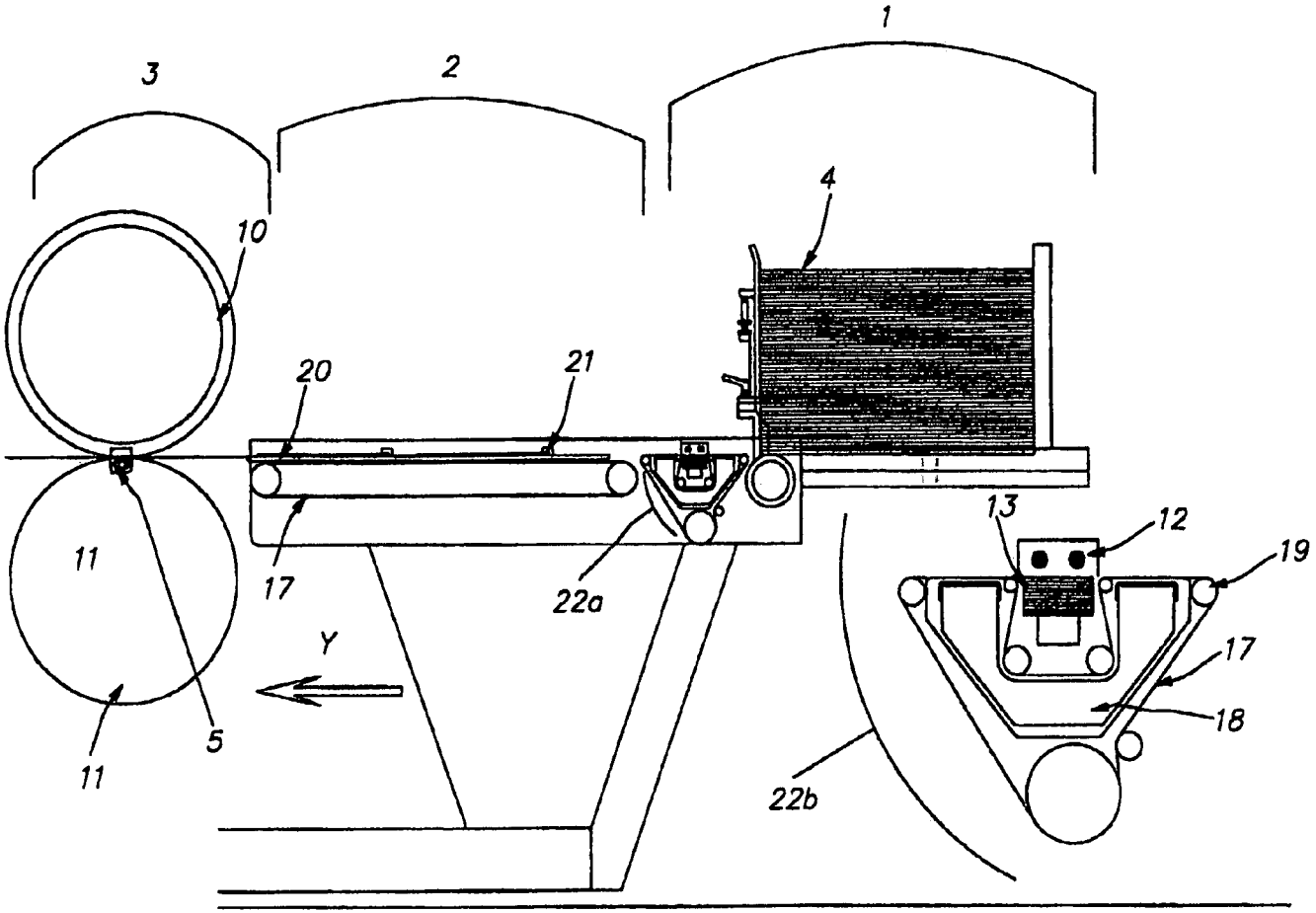
FIG. 4 shows a side view of a so-called high-speed feeder in accordance with the pusher system.

FIG. 4 shows a side view of a high-performance feeder, wherein the substrate sheets, after being separated, are guided over a vacuum belt 17 via sliders 21 and are guided on the grippers supported by guiding rods 20. After separation from the pile 4, the sheets are guided over a vacuum belt system 22.

The vacuum belts are sunk in this vacuum belt system 22 such that e.g. electrodes 12 can be integrated in an upper chamber and e.g. opposing terminals 13 can be integrated in a lower chamber to permit surface treatment such as e.g. corona treatment.

One particular feature of these feeders is their high speed and the fact that they permit processing of very thick materials (up to 4 mm thickness).

The upper processing cylinder 10 is part of the sheet-fed rotary printing or coating machine 3, wherein the system 2 and feeder 1 are connected upstream of the machine 3.

Figure 5:
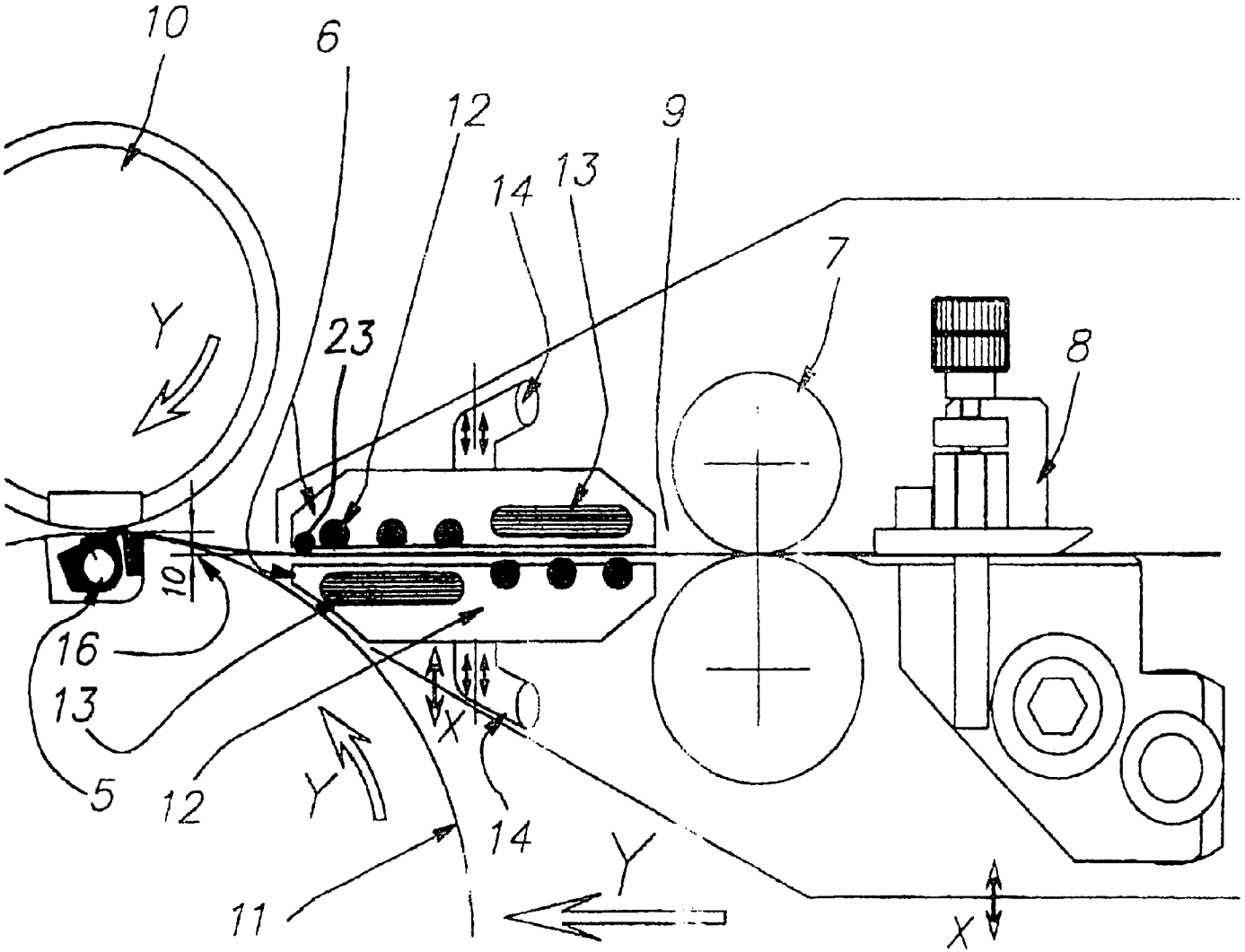
FIG. 5 shows an enlarged view in accordance with FIG. 3 of a further embodiment.

In one embodiment shown in FIG. 5, a neutral rod 23 follows the last electrode 12 (as viewed in the running direction Y of the sheets)- and is slightly offset from the plane of the electrodes 12 in a direction towards the sheets. This ensures that the sheets do not contact the electrodes 12 when they are gripped by the gripper system 5 and transported upwards.

LIST OF REFERENCE NUMERALS

1. Feeder unit
2. Feed system
3. Sheet-fed rotary printing or coating machine
4. Piled sheets
5. Sheet gripper system
6. Surface refinement system
7. Drawing rollers
8. Side mark
9. Momentary sheet stop
10. Upper processing cylinder
11. Lower counterpressure cylinder
12. Electrodes
13. Opposing terminals
14. Supply vacuum or blown air
15. Suction head to separate sheets
16. Lowered position
17. Vacuum belt
18. Vacuum chamber
19. Circulating rollers
20. Guiding rods
21. Pusher (slider)
22*a*. Vacuum belt system with surface refinement system
22*b*. Enlarged illustration of 22*a*
23. Rod
Arrow X height adjustment
Arrow Y running direction

I claim:

1. A machine for sheet-fed rotary printing and sheet coating, the machine comprising:

a sheet gripper system for holding a sheet during printing thereof, said sheet gripper system having a printing speed;

a feed system disposed upstream of said sheet gripper system for transporting the sheet to said sheet gripper system, said feed system adjusting a transport speed of the sheet to match said printing speed of said sheet gripper system, said feed system having means for aligning the sheet during a momentary sheet stop;

a feeder disposed upstream of said feed system to feed the sheet to said feed system;

a surface refinement station disposed downstream of said feeder and upstream of said sheet gripper system; and means for commonly adjusting a height of said feed system together with said surface refinement station in dependence on a sheet thickness.

2. The machine of claim 1, wherein said surface refinement station is a corona treatment device.

3. The machine of claim 2, wherein surface refinement is structured for intermittent application in a peripheral direction to match a size or separation of the sheets.

4. The machine of claim 2, wherein surface refinement is structured for omission in a transverse direction to match a surface to be printed on the sheet.

5. The machine of claim 2, wherein said surface refinement station is followed by sheet guiding means which are stationary to ensure a gap separation between electrodes of said corona treatment device and the sheet.

6. The machine of claim 2, wherein said surface refinement station is followed by sheet guiding means which pivot to ensure a gap separation between electrodes of said corona treatment device and the sheet guiding means.

7. The machine of claim 1, wherein surface refinement is carried out from above.

8. The machine of claim 1, wherein surface refinement is carried out from below.

9. The machine of claim 1, wherein an intensity of electric flaming surface refinement is adjusted in dependence on a production speed.

10. The machine of claim 1, wherein said height of said feed system and said surface refinement station is adjusted to effect a desired deflection of the sheet.

11. The machine of claim 1, wherein said surface refinement station comprises two closed chambers which are disposed above and below a passage of the sheet.

12. The machine of claim 11, wherein said closed chambers of said surface refinement station are structured for loading with controlled compressed air or suctioned air.

13. The machine of claim 11, wherein said chambers of said surface refinement station divert static electricity.

14. The machine of claim 11, wherein said chambers of said surface refinement station clean the sheet.

15. The machine of claim 11, wherein said chambers of said surface refinement station pre-heat the sheet.

16. The machine of claim 1, wherein a sheet guidance of said surface refinement station is air cushioned in a contactless fashion.

17. The machine of claim 1, further comprising in a neutral rod disposed downstream of said surface refinement station.

18. The machine of claim 17, wherein said neutral rod is shifted or offset relative to said surface refinement station in a direction towards the sheet to preventing contact between the sheet and said surface refinement station.

19. The machine of claim 1, wherein the machine is of series construction.

20. The machine of claim 1, wherein the machine is of satellite construction.

* * * * *